United States Patent [19]

Marchetti

[11] 4,187,869

[45] Feb. 12, 1980

[54] ORTHOPEDIC DEVICE

[76] Inventor: Pasquale F. Marchetti, 10 Fenway, Hastings on Hudson, N.Y. 10706

[21] Appl. No.: 957,143

[22] Filed: Nov. 3, 1978

[51] Int. Cl.[2] ..... A61H 3/04

[52] U.S. Cl. ..... 135/67; 135/68

[58] Field of Search ..... 135/67, 68, 71, 76, 135/66

[56] References Cited

U.S. PATENT DOCUMENTS

| | | | |
|---|---|---|---|
| 1,307,058 | 6/1919 | McGrath | 135/67 |
| 2,362,466 | 11/1944 | Carter | 135/67 |
| 2,792,874 | 5/1957 | Sundberg | 135/67 |
| 3,162,314 | 1/1965 | Clearman | 135/67 |
| 3,195,550 | 7/1965 | Ingalls | 135/67 |

*Primary Examiner*—Reinaldo P. Machado

*Attorney, Agent, or Firm*—Nims, Howes, Collison & Isner

[57] ABSTRACT

An orthopedic device for use as a "walker" for the aged or infirm. The orthopedic device having a tripod frame mounted on a U-shaped base element. Attached to the tripod frame are adjustable crutch-like shoulder support members and hand grips together with an adjustable seat for custom fitting the "walker" to the person. The seat is capable of moving downward and away from the user to permit the user to easily step in and out of the "walker".

8 Claims, 4 Drawing Figures

ORTHOPEDIC DEVICE

BACKGROUND OF INVENTION

This invention relates to an orthopedic device commonly known as a "walker" used by the aged or infirm and in particular to a versatile "walker" having adjustable crutch-like shoulder support members and handle grips together with an adjustable seat arrangement which enables a user to custom fit the "walker" to the user's physical requirement.

Heretofore "walkers" have been used which have a box-like construction with some height adjustments. Seats were moved backward or forward and some were capable of being folded up to permit the user to enter or exit. None of these combine shoulder crutches with hand grips and with a seat all of which are adjustable to custom fit the "walker" to the user. Furthermore, the seat arrangements are relatively fixed and do not permit a user to step easily into and out of the "walker."

SUMMARY OF THE INVENTION

The present invention overcomes the disadvantages of known "walkers" by providing crutch-like shoulder supports and hand grips which are adjustable to custom fit to the user. Furthermore, a seat arrangement is provided which is capable of being rotatable downward and away from the person using the "walker" to permit the user easily to step in and out of the "walker" when desired.

BRIEF DESCRIPTION OF THE DRAWINGS

In order that the invention may clearly be understood and readily carried into effect, a preferred embodiment will now be described, by way of example only, with reference to the accompanying drawings wherein.

DESCRIPTION OF A PREFERRED EMBODIMENT

Figure 1:
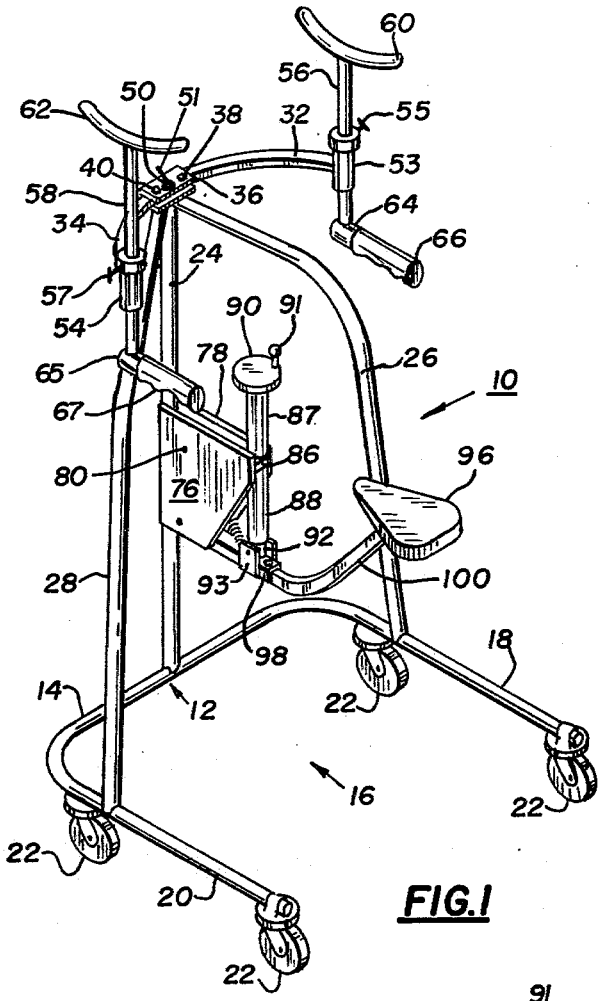
FIG. 1 is a perspective view of the apparatus according to the present invention.
Figure 2:
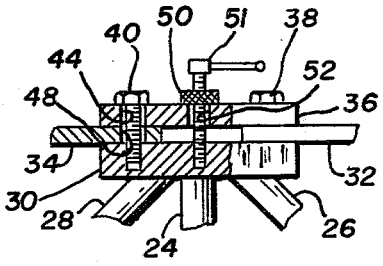
FIG. 2 is an enlarged front view with portions broken away showing the pivot plate, pressure plate and support arms of the invention shown in FIG. 1.

An orthopedic device 10 according to the present invention is shown in FIG. 1. The orthopedic device 10 includes a U-shaped base element 12 having a closed forward portion 14 and a rearward open end 16 with two base legs 18 and 20. The orthopedic device 10 is supported for rollable movement by casters 22. A hollow rod tripod frame is mounted to the base element 12 and includes a forward leg 24 mounted to forward portion 14 of base element 12 and two side legs 26 and 28 mounted to base legs 18 and 20 respectively with the apex of the tripod frame located vertically above the base element 12. At the apex of the tripod frame is affixed a pivot plate 30 which supports two rotatable support arms 32 and 34 as shown in FIGS. 1 and 2. A pressure plate 36 is mounted above the pivot plate 30 to lock the support arms in place by means of bolts 38 and 40. For purposes of description only, the mounting structure corresponding to bolt 40 will be described with reference to FIG. 2. The mounting structure for bolt 38 is the same. Bolt 40 extends slidably through bore 44 in pressure plate 36 and slidably through bore 48 in support arm 34 and is threadably received by pivot plate 30 as shown in FIG. 2. The bolts 38 and 40 are adjusted to provide some vertical movement between the pressure plate 36 and pivot plate 30 to permit the support arms 32 and 34 to be rotated. Locking bolt 50 with handle 51 is provided to lock the support arms 32 and 34 in position. Locking bolt 50 extends slidably through bore 52 in pressure plate 36 and is threadably received by pivot plate 30. As handle 51 is rotated, the pressure plate 36 is drawn toward or away from pivot plate 30 depending on the direction of rotation of handle 51. When the pressure plate 36 is drawn toward pivot plate 30, the two plates frictionally engage support arms 32 and 34 and lock them in place. Stepped cylinders 53 and 54 having axial bores (not shown) for receiving crutch staffs 56 and 58 are transversely mounted to the free ends of support arms 32 and 34 respectively—such that the crutch staffs 56 and 58 extend substantially vertically. The wider portion of these stepped cylinders 53 and 54 are adapted to receive split bushings (not shown) which surround the crutch staffs 56 and 58. Set screws 55 and 57 mounted in the side walls of the wider portions of these stepped cylinders 53 and 54 engage the split bushings which in turn frictionally engage the crutch staffs 56 and 58 to lock the crutch staffs 56 and 58 in any desired vertical position.

Figure 3:
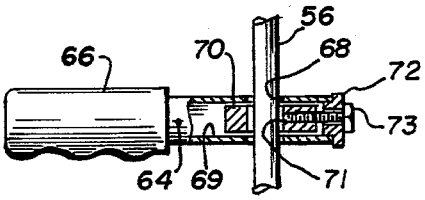
FIG. 3 is an enlarged front view of the hand grip mounted to a crutch staff of the invention shown in FIG. 1.

At the upper end of crutch staffs 56 and 58 are mounted conventional shoulder support members 60 and 62. At the lower ends of crutch staffs 56 and 58 are mounted hand grip rods 64 and 65 on which hand grips 66 and 67 are mounted as shown in FIG. 1 and FIG. 3. Each of the hand grip rods 64 and 65, has a transverse bore located adjacent one end thereof for receiving the respective crutch staffs 56 and 58. For purposes of explanation, FIG. 3 shows only one of the two hand grips. The other one is of identical construction. As shown in FIG. 3, crutch staff 56 is received by transverse bore 68 in hand grip rod 64. In addition, hand grip rod 64 has an axial bore 69 in which is positioned a slug 70 having a transverse bore 71 also for receiving the crutch staff 56. The open end of handle grip rod 64 adjacent the crutch staff 56 has a stepped washer 72 inserted therein to cover the open end. A bolt 73 extends through this washer and threadably engages slug 70. Slug 70 is sized so that when crutch staffs 56 and 58 extend through the transverse bore 71 in slug 70, the end of slug 70 adjacent the open end of handle grip rod 64 is spaced away from washer 72. Thus, when bolt 73 is rotated to draw plug 70 toward washer 72, the hand grip rod 64 is locked to crutch staff 56. When bolt 73 is loosened, hand grip rod 64 may be rotated with respect to crutch staff 56 and moved up and down the crutch staff 56 to any desired position.

Figure 4:
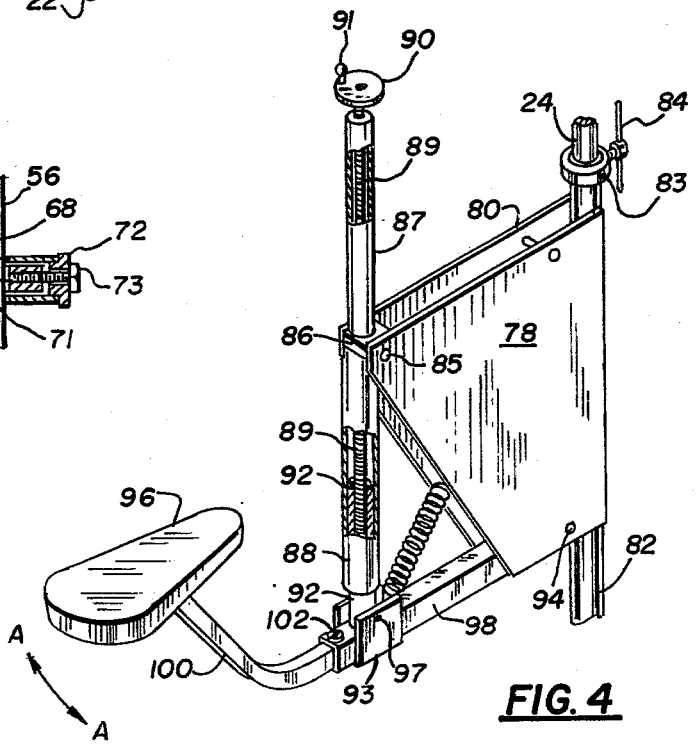
FIG. 4 is an enlarged front view of the seat and structure for mounting the seat to a forward leg of the tripod frame as shown in FIG. 1.

A supporting member 76 having two side supports 78 and 80 are mounted to a shaft 82 as shown in FIG. 4. Shaft 82 is sized to slidably surround forward leg 24. A collar 83 is fixed to shaft 82 and is adapted to receive split bushings (not shown) for surrounding forward leg 24. A set screw 84 is provided in collar 83 to engage the split bushings which in turn frictionally engage forward leg 24 to lock the supporting member 76 to the forward leg 24 at any desired vertical position.

The two side supports 78 and 80 rotatably support a bored block 86 by bolts 85 (only one of which is shown in FIG. 3, the other bolt 85 being on the reverse side of block 86). A tubular upper housing member 87 is welded to block 86 and a tubular lower housing member 88 is welded to block 86. Through the upper housing member 87, the block 86 and lower housing member 88 slidably extends a threaded shaft 89 as shown in FIG. 3. The upper end of threaded shaft 89 has a cover plate 90 affixed thereto and a handle 91 for rotating the threaded shaft 89. The lower end of threaded shaft 89 is threadably received by connecting member 92 which in turn is slidably received by lower tubular housing 88. The connecting member 92 is rotatably mounted by bolt 97 to a mounting collar 93 affixed to a telescoping seat support arm 94 intermediate its ends.

One end of the seat support arm 94 is rotatably mounted to side supports 78 and 80 by pin 95. The other end of seat support arm 94 is provided with a seat 96 preferably a bicycle-type seat. The seat support arm 94 has telescoping members 98 and 100 which are locked relative to one another by set screw 102.

As the crank handle 91 is turned, the seat 96 may be moved in the direction of the arrow A-A depending on the direction of the rotation of crank handle 90.

With the present invention, a "walker" is provided which is easily custom fit to the particular user. The user may easily step into the "walker" by lowering the seat 96 by turning handle 90. When the user wishes to use the "walker," handle 90 may be turned to raise the seat 96 until the seat is positioned to provide additional support for the user. When the user wishes to step out of the "walker," the handle 90 is turned to move the seat downward and away from the user.

While the fundamental novel features of the invention have been shown and described, it should be understood that various substitutions, modifications and variations may be made by those skilled in the art without departing from the spirit or scope of the invention. Accordingly, all such modifications and variations are included in the scope of the invention as defined by the following claims.

I claim:

1. An orthopedic device comprising:

a frame;

caster means for supporting the frame;

a pair of rotatable support arms;

a pivot plate affixed to the frame for supporting the pair of rotatable support arms in a substantially horizontal position for rotation in a substantially horizontal plane;

a crutch staff mounted intermediate the ends thereof to each support arm extending substantially above and below the support arm;

a shoulder support member affixed to the upper end of each crutch staff; and a hand grip mounted to the lower end of each crutch staff.

2. The orthopedic device according to claim 1 further including means for supporting a seat for rotation in a vertical plane and means for positioning the seat and retaining the seat at a selected position.

3. An orthopedic device comprising:

a U-shaped base element having a forward portion at the bottom of the U;

caster means for supporting the base element in a substantially horizontal position;

a three leg tripod frame having a forward leg mounted on the forward portion of the U-shaped base element and the other two side legs mounted on the two legs of the U-shaped base element respectively and an apex of the tripod frame located vertically about the horizontally positioned U-shaped base element;

a pair of rotatable support arms;

a pivot plate affixed to the tripod frame at the apex thereof for supporting the pair of rotatable support arms in a substantially horizontal position for rotation in a substantially horizontal plane;

a crutch staff mounted intermediate the ends thereof to each support arm extending substantially vertically above and below the support arm;

a shoulder support member affixed to the upper end of each crutch staff;

a hand grip mounted to the lower end of each crutch staff.

4. The orthopedic device according to claim 3 further including a supporting member mounted to the forward leg below the apex of the tripod frame having a block with a threaded bore for retaining a threaded shaft in a substantially vertical position, the threaded shaft having a handle at its upper end of the threaded shaft, one end of the seat support arm being rotatably mounted to the supporting member, the other end of the seat support arm having a seat means mounted thereto, whereby when the threaded shaft is rotated the seat means may be rotated upwardly or rotated downwardly depending on the direction of rotation of the threaded shaft.

5. The orthopedic device according to claim 4 further including means for adjustably mounting the supporting member to the forward leg of the tripod frame whereby the supporting member may be selectively positioned vertically on the forward leg.

6. The orthopedic device according to claim 4 wherein the seat support arm comprises telescoping members and further including means for adjustably locking the telescoping members relative to one another whereby the length of the seat support arm may be selected.

7. The orthopedic device according to claim 3 further including means for adjustably mounting the crutch staff intermediate the ends thereof to each support arm whereby the height of each shoulder support arm above the corresponding support arm may be selected.

8. The orthopedic device according to claim 3 wherein each hand grip has a substantially vertical bore for receiving the crutch staff and further includes means for selectively locking the hand grip on the crutch staff whereby the hand grip may be selectively rotated with respect to and selectively positioned vertically on the crutch staff and locked in the desired position.

* * * * *